US005482114A

United States Patent [19]

Lu

[11] Patent Number: 5,482,114

[45] Date of Patent: Jan. 9, 1996

[54] CHARGED AIR COOLER MOUNTING BARS

[75] Inventor: James W. B. Lu, Mt. Pleasant, S.C.

[73] Assignee: Behr Heat Transfer Systems, Inc., Charleston, S.C.

[21] Appl. No.: 387,348

[22] Filed: Feb. 13, 1995

[51] Int. Cl.[6] ..... F28F 9/00

[52] U.S. Cl. ..... 165/149; 165/906

[58] Field of Search ..... 165/81, 149, 906

[56] References Cited

U.S. PATENT DOCUMENTS

| | | | |
|---|---|---|---|
| 1,618,797 | 2/1927 | Bennett | 165/149 |
| 1,884,210 | 10/1932 | Potter | 165/149 X |
| 4,619,313 | 10/1986 | Rhodes et al. | 165/67 |
| 4,862,953 | 9/1989 | Garnetzke et al. | 165/67 |

FOREIGN PATENT DOCUMENTS

| | | | |
|---|---|---|---|
| 4-288485 | 10/1992 | Japan | 165/149 |
| 13091 | of 1906 | United Kingdom | 165/149 |

*Primary Examiner*—Allen J. Flanigan
*Attorney, Agent, or Firm*—Howard & Howard

[57] ABSTRACT

A heat exchanger (10) is comprised of a pair of manifolds (12, 14) with a heat exchanger core (20) therebetween, and an upper side support (22) and a lower side support (44) along the outer sides of the core (20) connected between the manifolds (12, 14). The upper side support (22) includes mounting brackets (40). The lower side support (44) comprises the mounting bracket. A pair of loading members (52) are connected between the lower mounting bracket (44) and the manifolds (12, 14) in angular relationship thereto to allow additional support and loading through the manifolds (12, 14), and to allow thermal expansion of the exchanger (10) with minimal restriction.

8 Claims, 1 Drawing Sheet

CHARGED AIR COOLER MOUNTING BARS

TECHNICAL FIELD

The subject invention relates to the mounting of heat exchangers of the type having a pair of manifolds with a core member connected therebetween, the core member including a plurality of fluid tubes and fins with outer structural side supports extending between the manifolds.

BACKGROUND OF THE INVENTION

Commonly known in the art are heat exchangers used in connection with an automotive vehicle for cooling the engine of the vehicle. The heat exchanger generally comprises a pair of manifolds providing fluid reservoirs and a plurality of fluid tubes extending between the manifolds in fluid communication therewith. Liquid coolant may pass through the manifolds in a liquid to air heat exchanger while air is passed external and between the tubes for cooling the fluid contained therein. In air to air heat exchangers, air is passed within the tubes and air is passed externally thereover for heat exchange.

The components of the heat exchanger are generally welded or soldered together. The core, comprising the tubes, fins and side support members receives ambient cooling air passing through and around the cooling fins and is disbursed about the fluid tube, thereby allowing the fluid to release the majority of its thermal energy. The high temperature air flow causes thermal expansion of the tubes. It is desirable to minimize the restriction of thermal expansion when mounting a heat exchanger.

In typical vehicle cooling systems, the charged air cooler is generally mounted onto the radiator at the manifolds. The radiator is in turn, mounted onto the chassis of the vehicle. Because the tanks are the stronger part of the heat exchanger, the installation can take the load due to the vehicular vibration.

In come cases, the cooler is mounted on the radiator on its side by the structural side supports. A pair of mounting tabs or brackets extend from each side support and are directly connected to the vehicle. Since the side supports are relatively weak, the bottom side support has to be specifically designed in order to sustain the required loading.

Another type of mounting bracket is disclosed in U.S. Pat. No. 4,862,953, issued Sep. 5, 1989 in the name of Garnetzke et al. The patent discloses a heat exchanger including fluid tubes, fins spaced between the tubes, and upper and lower mounting flanges. A support brace extends perpendicularly with respect to the fluid tubes and is connected to both the upper and lower mounting flanges or side supports.

A problem still exists due to the weakness of the side supports and the inability to provide the necessary support for mounting the charged air cooler.

SUMMARY OF THE INVENTION

The invention includes a heat exchanger assembly comprising a pair of manifolds having openings to convey fluid therethrough and including first and second distal ends. A core member is connected between the pair of manifolds and between the first and second distal ends for conveying fluid between the manifolds through the core member for heat exchange. The core member includes a plurality of fluid tubes extending and connected between the manifolds for communicating fluids, a plurality of fins connected between the fluid tubes for enhancing heat exchange with fluid within the fluid tubes, and an upper structural side support member extending between the manifolds at the distal ends. A lower structure side support member comprises a mounting bracket which extends between and is connected to the manifolds at the distal ends for mounting the assembly in operation. The assembly is characterized by including loading members extending and connected between the mounting bracket and the manifolds to provide support of the assembly through the manifolds and the mounting bracket.

The assembly aids the side support member to sustain the vibration loading. The loading members are added between the mounting points and the manifolds so that a part of the load will be transmitted to the manifolds allowing the manifolds to share part of the load. Therefore, side mounting assemblies are stronger and can achieve better performance while making the side support simpler, lighter and less expensive.

FIGURES IN THE DRAWINGS

Other advantages of the present invention will be readily appreciated as the same becomes better understood by reference to the following detailed description when considered in connection with the accompanying drawings wherein:

FIG. 1 is a partially cut away, front elevational view of the heat exchanger according to the subject invention; and FIG. 2 is a cross sectional side view taken along lines 2—2 of FIG. 1.

DETAILED DESCRIPTION OF THE PREFERRED EMBODIMENT

Figure 1:
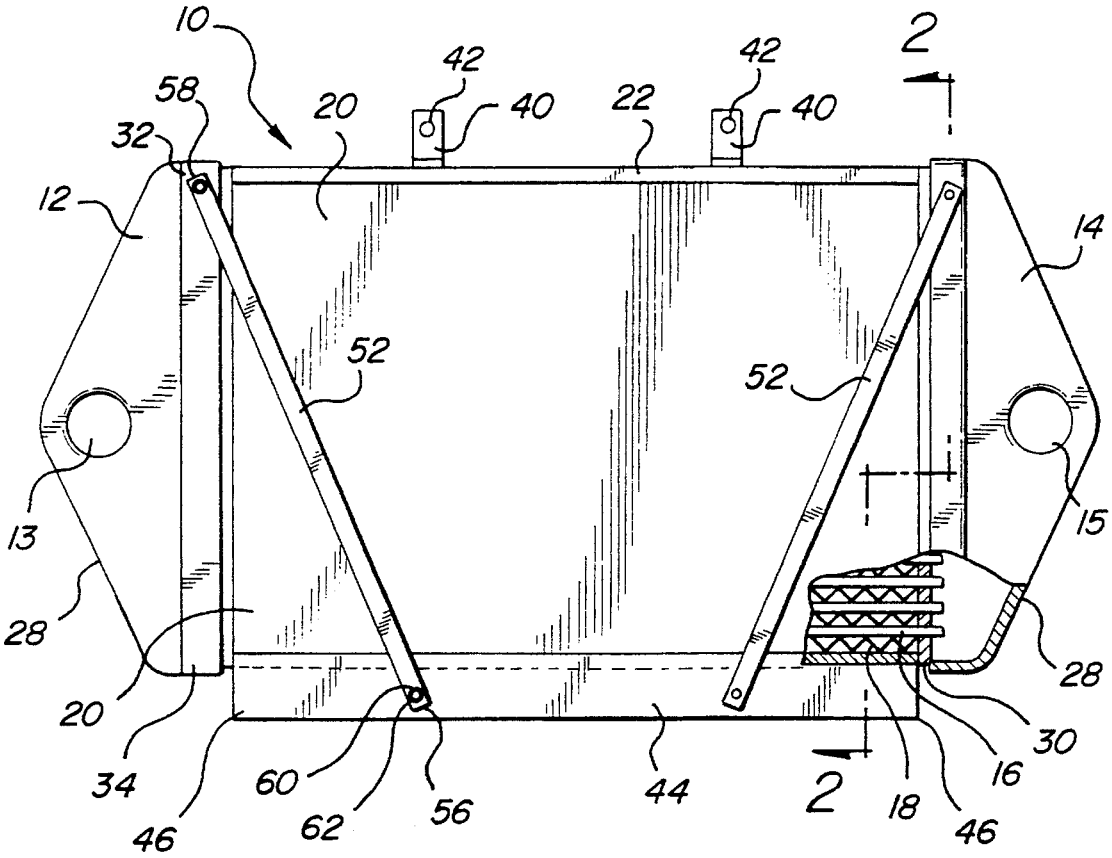

A heat exchanger assembly of the type commonly used in connection with an automotive vehicle is illustrated at 10 in FIG. 1. The heat exchanger assembly 10 comprises a pair of manifolds 12, 14 providing fluid reservoirs. A core member 20 is connected between the manifolds 12, 14 for conveying fluid from the manifolds 12, 14 through the assembly 10. The core member 20 comprises a plurality of fluid tubes 16 and fins 18. The plurality of fluid tubes 16 extend between the manifold 12, 14 for communicating a fluid, either a liquid or gas, through the heat exchanger assembly 10. The plurality of external fins 18 extend between adjacent fluid tubes 16 in either air-to-air or liquid-to-air exchangers. Such heat exchangers are commonly known in the art.

The core member 20 also includes a pair of side support members 22, 44 extending between the manifolds 12, 14 providing sides of the core member 20 to aid in supporting the fluid tubes 16 and fins 18 therebetween, and further to provide additional interconnection of the core member 20 between the manifolds 12, 14.

In general, as a heated or charged fluid passes through the fluid tubes 16, heat is absorbed therefrom by a cooling fluid, preferably ambient air, flowing about the exterior of the fluid tubes 16 through the fins 18. The cooling fluid exits from the assembly 10 at a higher temperature due to the exchange of heat with the fluid tubes 16. The "charged" or heated fluid within the tubes 16 is thus cooled to a lower temperature and exits the assembly 10 by way of an outlet 15 in the manifold 14. The other manifold 12 generally includes an inlet 13 for communicating fluid into the assembly 10 from the vehicle engine, i.e., turbo charger.

Figure 2:
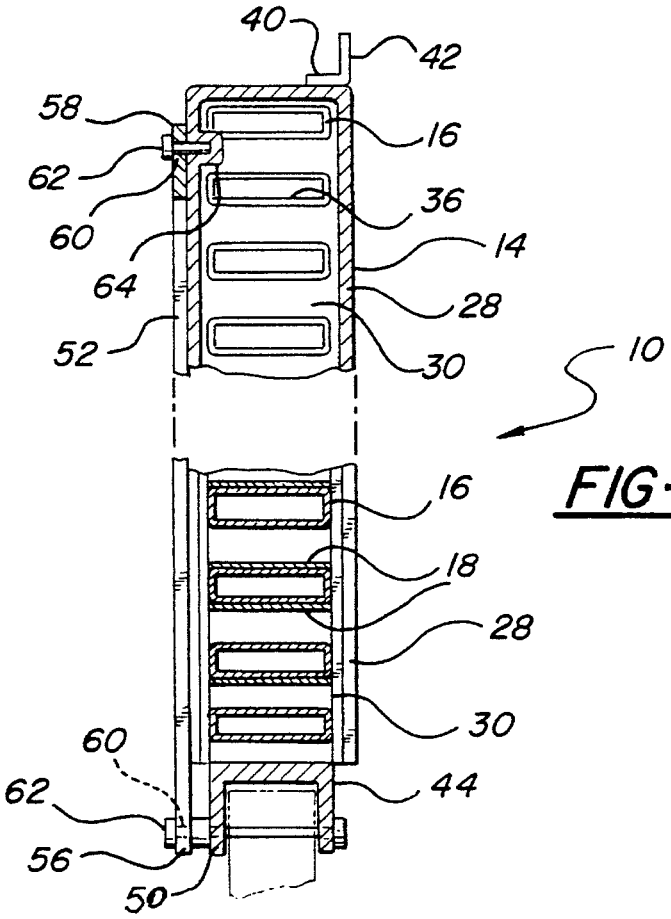

The fluid tubes 16 are comprised of generally flat-sided tubes, oblong in cross section, as generally indicated in FIG. 2. The fluid tubes 16 may include internal turbulators to increase heat exchange, as commonly known in the art.

The fins 18 are positioned between adjacent fluid tubes 16 for directing the cooling fluid or air about the outer portion of the fluid tubes 16. Such fins 18 generally comprise corrugations of sheet material as commonly known in the art. In general, the assembly 10 allows the fluid to circulate through the fluid tubes 16 and manifolds 12, 14 while cool air is passed over the fins 18 and about the tubes 16 to cool the internal fluid medium.

The manifolds 12, 14 are each comprised of a tank portion 28 and a header portion 30 forming the reservoirs therebetween. The tank portions 28 generally includes the inlet opening 13 and outlet opening 14 in either of the manifolds 12, 14. This allows the fluids to enter and exit the assembly 10. Furthermore, the header portion 30 comprises a flat, longitudinal member having a plurality of apertures 36 therein for receiving the ends of the fluid tubes 16. In use, it is commonly known that the tank portion 28 is welded or soldered to the header portion 30 to form the manifold 12, 14 with the fluid tubes 16 either soldered or braze sealed to the header portions 30 to provide a unitary assembly 10.

More specifically, each of the manifolds 12, 14 comprise upper and lower longitudinal distal ends 32, 34. The side support members 22, 44 extend between and adjacent the distal ends of the opposing manifolds 12, 14 at the outer edge of the core member 20. The side support members 22, 44 are generally comprised of rigid, structural members, longitudinally extending between the distal ends 32, 34 of the manifolds 12, 14 about the exterior sides of the core member 20. The side support members 22, 44 provide the structural support of the core element to and between the manifolds 12, 14. The side support members 22, 44 are generally soldered to the outermost fins 18 and welded or soldered to the manifolds 12, 14, i.e., headers 30. Such assembly is commonly known in the art.

The side support members 22, 44 generally include mounting flanges extending therefrom to allow mounting of the heat exchanger 10 in a vehicle. In the preferred embodiment, the heat exchanger assembly 10 is turned on its side for mounting, i.e., the manifolds 12, 14 are on the sides with the upper 22 and lower 44 side support members. The upper side support member 22 includes a pair of brackets 40 with apertures 42 therethrough for securing to the vehicle. The lower side support member 44 comprises a longitudinal bracket extending the length thereof and is of generally U-shaped configuration. The bracket 44 includes distal ends 46 adjacent the lower distal ends 34 of the manifolds 12, 14, and includes a pair of spaced apertures 50 therethrough to allow mounting of the assembly 10. The apertures 50 are spaced from the manifold distal ends 34 and extend through each opposing leg of the U-shaped bracket 44.

The invention is characterized by including loading members 52 extending and connected between the mounting bracket 44 and the manifolds 12, 14 to provide additional support to the assembly 10 through the manifolds 12, 14 and the mounting bracket 44. The loading members 52 comprises a longitudinal member extending between first and second load ends 56, 58. The first load end 56 is connected to the longitudinal bracket 44 with the longitudinal member extending across the core member 20 with the second load end 58 connected to the manifold 12, 14. The loading members 52 are rigid structural member such as made out of rigid metal. The loading members 52 may be typically a metal rod or bar to provide loading support between the bracket 44 and manifolds 12, 14.

Each of the load ends 56, 58 include an aperture 60 therethrough. The first load end 56 is connected adjacent the mounting apertures 50 of the mounting bracket 44. A fastener 62 may be extended through the apertures 56, 60, as best illustrated in FIG. 2, to fasten the assembly 10 to a vehicle structure. The second load end 58 is connected to the manifolds 12, 14 also by a fastener 62 extending between the aperture 60 and a molded channel or recess 64 in the tank 28. Alternatively, the second end 58 may be welded directly to the tank 28. As can be seen, the loading members 52 extend from a central portion of the mounting bracket 44 to the upper distal ends 32 of the manifolds 12, 14 at the tank 28. Therefore, the loading members 52 are generally angular with respect to the fluid tubes 16, i.e., less than 90° angle with respect thereto.

The loading members 52 help the side support member 44 to sustain the vibration of the vehicle by transmitting a portion of the load to the tanks 28 or manifolds 12, 14. Furthermore, the configuration of the loading members 52 allow for thermal expansion of the assembly 10 which will avoid thermal stresses thereon.

The invention has been described in an illustrative manner, and it is to be understood that the terminology which has been used is intended to be in the nature of words of description rather than of limitation.

Obviously, many modifications and variations of the present invention are possible in light of the above teachings. It is, therefore, to be understood that within the scope of the appended claims wherein reference numerals are merely for convenience and are not to be in any way limiting, the invention may be practiced otherwise than as specifically described.

What is claimed is:

1. A heat exchanger assembly comprising:

a pair of manifolds (12, 14) having openings (13, 15) to convey fluid therethrough and including first and second distal ends (32, 34);

a core member (20) connected between said pair of manifolds (12, 14) and between said first and second distal ends (32, 34) for conveying fluid between said manifolds (12, 14) and through said core member (20) for heat exchange;

said core member (20) including a plurality of fluid tubes (16) extending and connected between said manifolds (12, 14) for communicating fluid, a plurality of fins (18) connected between said fluid tubes (16) for enhancing heat exchange with fluid within said fluid tubes (16), and an upper structural side support member (22) extending between and connected to said manifolds (12, 14) at said distal ends;

a lower structural side support member comprising a mounting bracket (44) extends between and is connected to said manifolds (12, 14) at said distal ends for mounting said assembly in operation; and said assembly characterized by including loading member (52) extending between and directly connected to said mounting bracket (44) and said manifold (12, 14) to provide support of said assembly through said manifolds (12, 14) and said mounting bracket (44).

2. An assembly as set forth in claim 1 further characterized by said loading members (52) comprising longitudinal members extending between first and second load ends (56, 58), said first load ends (56) connected to said mounting bracket (44) and said second load ends (58) connected to said manifolds (12, 14) with said longitudinal member extending across said core member (20).

3. An assembly as set forth in claim 2 further characterized by said mounting bracket (44) including a mounting aperture (50) therethrough and spaced from said distal ends (32, 43) for receiving a fastener (62) to mount said assembly (10) to a structure in operation.

4. An assembly as set forth in claim 3 further characterized by said mounting bracket (44) comprising a U-shaped bracket with opposing legs connected to said core member (20) with said opposing legs extending outwardly therefrom, including two pairs of spaced apertures (50) extending through both of said legs.

5. An assembly as set forth in claim 4 further characterized by said first load ends (56) of said loading members (52) including apertures (60) therethrough for aligning with said pairs of apertures (50) to receive a fastener through said apertures (50, 60).

6. An assembly as set forth in claim 5 further characterized by including a pair of said loading members (52) connected to said manifolds (12, 14) and said bracket (44) across said core member (20).

7. An assembly as set forth in claim 6 further characterized by said loading members (52) comprising a longitudinal, substantially straight, structural bar.

8. An assembly as set forth in claim 7 further characterized by said loading members (52) comprising a longitudinal, substantially straight, structural rod.

* * * * *